US008241559B2

(12) United States Patent
Pelsoeczy

(10) Patent No.: US 8,241,559 B2
(45) **Date of Patent: *Aug. 14, 2012**

(54) STEEL MATERIAL HAVING A HIGH SILICON CONTENT FOR PRODUCING PISTON RINGS AND CYLINDER SLEEVES

(75) Inventor: Laszlo Pelsoeczy, Burscheld (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 555 days.

This patent is subject to a terminal disclaimer.

(21) Appl. No.: 12/377,789

(22) PCT Filed: May 7, 2007

(86) PCT No.: PCT/EP2007/004012

§ 371 (c)(1), (2), (4) Date: Oct. 15, 2009

(87) PCT Pub. No.: WO2008/019717

PCT Pub. Date: Feb. 21, 2008

(65) Prior Publication Data

US 2010/0192895 A1 Aug. 5, 2010

(30) Foreign Application Priority Data

Aug. 17, 2006 (DE) ..... 10 2006 038 670

(51) Int. Cl.

| | |
|---|---|
| ***C22C 38/02*** | (2006.01) |
| ***C22C 38/08*** | (2006.01) |
| ***C22C 38/34*** | (2006.01) |
| ***C22C 38/40*** | (2006.01) |
| ***C21D 9/40*** | (2006.01) |
| ***C21D 6/00*** | (2006.01) |

(52) U.S. Cl. ..... 420/117; 420/118; 420/119; 420/108; 420/109; 420/100; 420/101; 420/102; 148/320; 148/333; 148/334; 148/335; 148/336; 148/662

(58) Field of Classification Search ..... 420/117, 420/118, 108, 112, 99, 109, 119, 100–102; 148/320, 333–336, 662

See application file for complete search history.

(56) References Cited

U.S. PATENT DOCUMENTS 1,728,360 A * 9/1929 Parsons, Jr. ..... 420/118

(Continued)

FOREIGN PATENT DOCUMENTS

JP 50028419 * 3/1975

(Continued)

OTHER PUBLICATIONS

Database WPI Week 197631 Derwent Publications Ltd., Longdon, GB; AN 1976-58274X XP002453567 & JP50 028419A, Teikoku Piston Ring Co LTD Mar. 24, 1975 Zusammenfassung.

*Primary Examiner* — Deborah Yee

(74) *Attorney, Agent, or Firm* — Robert L. Stearns; Dickinson Wright, PLLC

(57) ABSTRACT

The invention relates to a steel material having a high silicon content, and to a method for the production thereof, the steel material being particularly suitable for piston rings and cylinder sleeves. In addition to iron and production-related impurities, the steel material contains 0.5 to 1.2 wt. % carbon, 3.0 to 15.0 wt. % silicon and 0.5 to 4.5 wt. % nickel. Also, the steel material can contain small amounts of the following elements Mo, Mn, Al, Co Nb, Ti, V, Sn, Mg, B, Te Ta La, Bi, Zr, Sb, Ca, Sr, Cer, rare earth metals and nucleating agents such as NiMg, MiSiMg, FeMg and FeSIMg. due to the high Si content, a degree of saturation higher than 1.0 is attained, with the melting temperature of the steel material corresponding to normal cast iron. The steel material can be produced according to a conventional cast-iron technique and has a high resistance to wear and tear and a high structural strength (minimal distortion).

18 Claims, 3 Drawing Sheets

U.S. PATENT DOCUMENTS

| | | | | | |
|---|---|---|---|---|---|
| 1,861,568 | A | * | 6/1932 | Hodson | 420/13 |
| 2,280,284 | A | * | 4/1942 | Critchett et al. | 420/83 |
| 2,610,912 | A | | 9/1952 | Millis | |
| 3,129,095 | A | | 4/1964 | Luce et al. | |
| 3,679,400 | A | * | 7/1972 | Nachtman | 420/84 |
| 390,925 | A | | 9/1975 | Kuriyama et al. | |
| 4,426,426 | A | | 1/1984 | Muehlberger | |
| 5,352,271 | A | * | 10/1994 | Margaria et al. | 75/526 |
| 2006/0191508 | A1 | * | 8/2006 | Otsuka et al. | 123/193.6 |

FOREIGN PATENT DOCUMENTS

| | | | |
|---|---|---|---|
| JP | 360155645 | * | 8/1985 |

* cited by examiner

STEEL MATERIAL HAVING A HIGH SILICON CONTENT FOR PRODUCING PISTON RINGS AND CYLINDER SLEEVES

BACKGROUND OF THE INVENTION

1. Technical Field

The present invention relates to a silicon-alloyed cast steel material which is more preferably suitable for piston rings and cylinder liners. The invention moreover relates to piston rings and cylinder liners which comprise such a steel material as main casting. The invention furthermore relates to a method for the manufacture of a silicon-alloyed cast steel material.

2. Related Art

Piston rings seal the gap that exists between the piston head and the cylinder wall against the combustion chamber. During the up and down movement of the piston, the piston ring on the one hand slides with its outer circumferential face in continuously resilient contact against the cylinder wall, on the other hand the piston ring, due to the tilting movements of the piston, slides in its piston ring slot in an oscillating manner, wherein its flanks alternately contact the upper or lower slot flank of the piston ring slot. With the sliding partners each of which runs against the other, more or less severe wear occurs as a function of the material, which wear upon dry operation can lead to so-called seizures, scoring and finally destruction of the engine. In order to improve the sliding and wear behaviour of piston rings relative to the cylinder wall the latter was provided with coatings of various materials on its circumferential surface.

To manufacture parts of internal combustion engines subjected to high loads such as for example piston rings, cast iron materials or cast iron alloys are mostly used. In engines subject to high loads, piston rings, more preferably, compression rings, are subjected to increasing loads among these compression peak pressure, combustion temperature, EGR, lubricating film reduction which decisively influence their operational characteristics such as wear, firing resistance, microwelding and corrosion resistance.

DE 3717297 for example discloses a piston ring of cast iron as sole material with cast iron white-solidified only in a region in its outer circumferential surface caused through exposing the cast iron material to radiation of high energy density and with thermally loaded intermediate region formed between the cast iron base metal and white solidified region.

EP 0821 073 discloses a cast iron alloy with pearlitic basic structure and spherical and vermicular graphite precipitations which, because of the strength values which are also resistant at high temperatures, can more preferably be used for application in piston rings.

The cast iron materials according to the prior art however have a high fracture risk so that when using current materials ring fractures frequently occur. Increased mechanical-dynamic loads result in shorter life spans of piston rings or cylinder liners. Intensive wear and corrosion on running surface and flank likewise occurs.

Higher ignition pressures, reduced emissions as well as direct fuel injection mean increasing loads for piston rings. The consequence is damage and plating-on of piston material mainly on the lower piston ring flank.

Because of the higher mechanical and dynamic loads of piston rings ever more engine manufacturers demand piston rings of high-quality steel (tempered and highly alloyed such as for example material 1.4112). Iron materials with less than 2.08% by weight of carbon are designated as steel. If the carbon content is higher, it is called cast iron. Steel materials have better strength and toughness properties since there is no interference through free graphite in the basic structure.

High chromium-alloyed martensitic steels are mostly used for producing steel piston rings. However, using these steels has the disadvantage that the manufacturing costs compared with cast iron components are significantly higher. Since the steel is purchased as wire (analytically defined material) from external suppliers at relatively great expense less added value is achieved.

Steel piston rings are manufactured from profile wire. The supplied profile wire is wound round, cut open and pulled over an "out-of-round" mandrel. On this mandrel the piston ring receives its desired out-off-round shape through a heat-treatment process, as a result of which the required tangential forces are set. A further disadvantage of the manufacture of piston rings from steel is that from a certain diameter the ring manufacture (winding) from steel wire is no longer possible. In contrast, piston rings of cast iron are already cast out-off-round so that they have an ideal shape from the start.

Further advantages of this manufacturing method of steel piston rings are the dependency on the suppliers (since there are only a few) and the inflexibility in terms of material changes and chemical composition.

Cast iron has a substantially lower melting temperature than steel. Depending on the chemical composition the difference can amount to as much as 350° C. Cast iron is thus easier to melt and cast since a lower melting temperature means a lower casting temperature and thus less contraction due to cooling, as a result of which the cast material comprises fewer blow holes as well as heat and cold cracks. A lower casting temperature furthermore results in less load on the mould material (erosion, gas porosities, sand inclusions) and the oven as well as lower melting costs.

SUMMARY OF THE INVENTION

The object of the present invention therefore is to make available a steel material which, through being manufactured by gravity casting, exceeds the properties of tempered cast iron with spherical graphite in at least one of the following points:

- Mechanical properties such as modulus of elasticity, bending strength
- Resistance to fractures
- Fatigue strength
- Flank wear
- Running surface wear Furthermore, the steel material is to be suitable for cost-effective manufacture with the techniques which are also employed for the manufacture of cast iron.

THE DRAWINGS

In the Figures it shows:

FIG. 1 an enlarged detail (100:1) of a material produced with the method according to the invention;

FIG. 2 an enlarged detail (500:1) of the material from FIG. 1;

FIG. 3 an enlarged detail (1000:1) of the material from FIG. 1;

DETAILED DESCRIPTION

Figure 1:
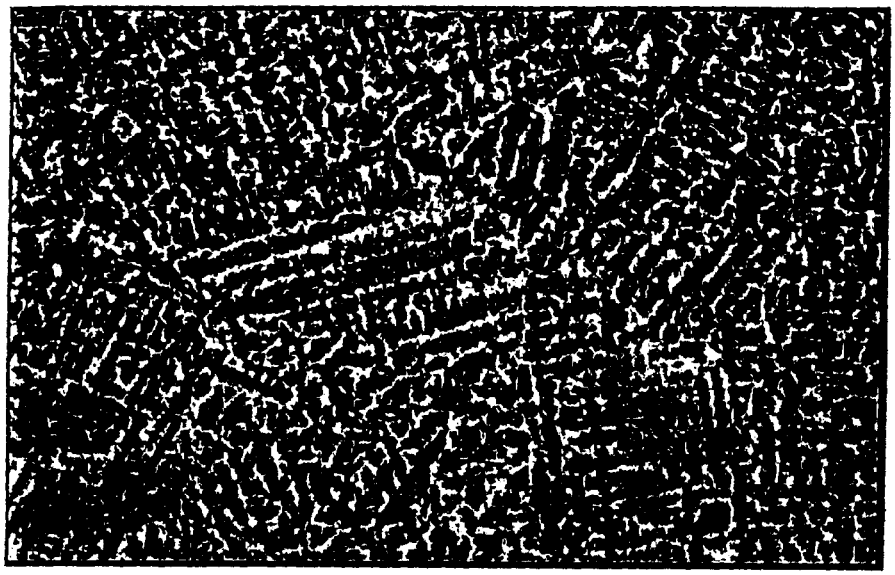
Figure 2:
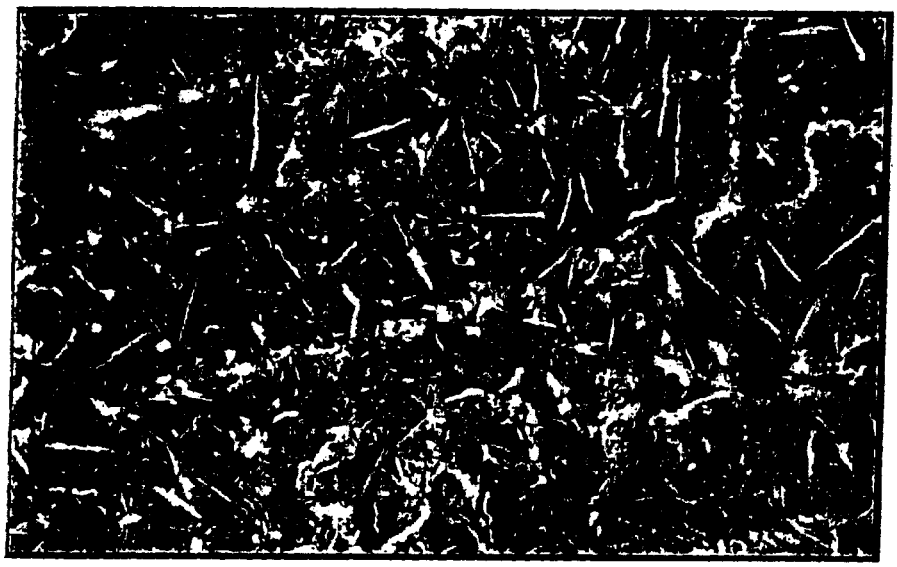
Figure 3:
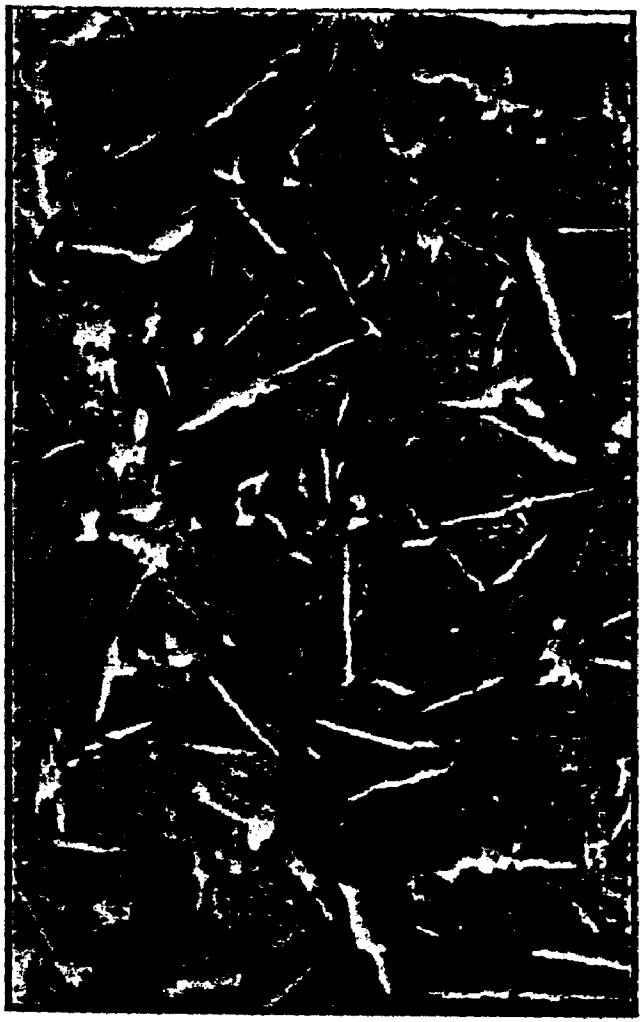

The melting temperature of the iron material not only depends on its carbon content, but also on the "saturation degree". The simplified formula applies:

$$S_e = C/(4.26 - \tfrac{1}{3}(Si+P))$$

The closer the saturation degree is to 1, the lower is the melting temperature. With cast iron, the target mostly is a saturation degree of 1.0 when the cast iron has a melting temperature of 1150° C. The saturation degree of steel is approximately 0.18 depending on the chemical composition. Eutectic steel has a melting temperature of 1500° C.

The saturation degree can be significantly influenced through the Si and/or P-content. For example a content of silicon that is higher by approximately 3% by weight has an effect similar to that of a C-content that is higher by 1% by weight. It is thus possible to produce a steel material with a C-content of 1% by weight and 9.78% by weight of silicon, which has the same melting temperature as cast iron with a saturation degree of 1.0 (C: 3.26% by weight, Si: 3.0% by weight).

Through the drastic increase of the Si-content the saturation degree of the steel material is increased and the melting temperature lowered to the level of cast iron. Thus it is possible to produce steel with the help of the technique that is also used for manufacturing cast iron, for example GOE44.

Silicon present in higher quantities influences the hardenability of the material negatively, since the austenite conversion temperature "Ac3" is increased. According to the invention, nickel is added against this negative "silicon effect" which as austenite forming agent expands the gamma area and shifts the Ac3 downwards, as a result of which hardening of the highly siliciferous steel becomes possible.

A steel material according to the invention has the following composition in % by weight:

| | |
|---|---|
| C: | 0.5 to 1.2 |
| Si: | 3.0 to 15.0 |
| Ni: | 0.5 to 4.5 |
| P: | 0 to 0.035 |
| S: | 0 to 0.035 |
| Cr: | 0 to 3.0 |

Remainder: Fe and contaminations due to the manufacture, wherein the steel material does not contain any tungsten.

It is preferable that furthermore at least one of the alloying components Mo, Mn, Al, Co, Cu, Cr, Nb, Ti, V, Sn or Mg is contained in the steel material in the corresponding quantity listed in % by weight:

| | | | |
|---|---|---|---|
| Mo: | 0 to 0.5 | Nb: | 0 to 0.01 |
| Mn: | 0 to 1.0 | Ti: | 0 to 0.05 |
| Al: | 0 to 0.05 | V: | 0 to 0.05 |
| Co: | 0 to 0.05 | Sn: | 0 to 0.05 |
| Cu: | 0 to 0.1 | Mg: | 0 to 0.01 |

The steel material can furthermore contain at least one element which is selected from the group consisting of tantalum, boron, tellurium or bismuth or their combinations, more preferably in a quantity of up to 0.1% by weight.

Furthermore, the steel material can contain at least one additive material which is selected from the group consisting of aluminium, zirconium, antimony, calcium, strontium, lanthanium, cerium, rare earth metals or their combinations, preferably in a quantity of up to 1% by weight.

Rare earth metals, such as NiMg, NiSiMg, FeMg or FeSiMg as well, are utilized as nucleus forming agents and/or for deoxidation. Particularly preferred is the addition of FeSiMg. Rare earth metals also encompass mixtures of lanthanoids with oxides of other metals. These elements and additive materials can be contaminations due to the manufacture or be added to the melt during the method for the manufacture of the steel material according to the invention.

The contents are contained in such a manner that the sum of all mentioned or not explicitly mentioned starting materials, component parts, content materials, elements, additive materials always produce 100% by weight. The proportion of starting materials, component parts, content materials, elements and additive materials can be set through various methods known to the person skilled in the art. The chemical composition is more preferably set as a function of the workpiece to be manufactured.

It is preferred that at least one of the alloying component parts C, Si, Ni, P, S, Mo, Mn, Al, Co, Cu, Cr, Nb, Ti, V, Sn or Mg is contained in the steel material in the corresponding quantity listed in % by weight:

| | | | | | |
|---|---|---|---|---|---|
| C: | 0.5 to 1.5 | Mo: | 0.1 to 0.5 | Nb: | 0 to 0.005 |
| Si: | 3.0 to 10.0 | Mn: | 0.1 to 0.5 | Ti: | 0 to 0.01 |
| Ni: | 0.5 to 3.5 | Al: | 0 to 0.01 | V: | 0 to 0.05 |
| P: | 0 to 0.02 | Co: | 0 to 0.02 | Sn: | 0 to 0.05 |
| S: | 0 to 0.03 | Cu: | 0 to 0.05 | Mg: | 0 to 0.01 |

Figure 4:
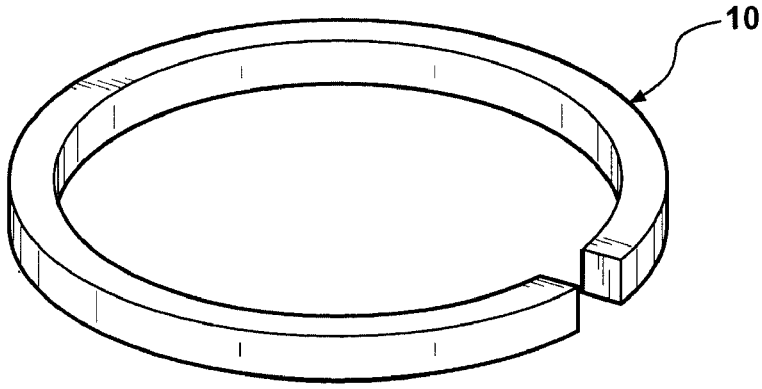
FIG. 4 illustrates a piston ring.
Figure 5:
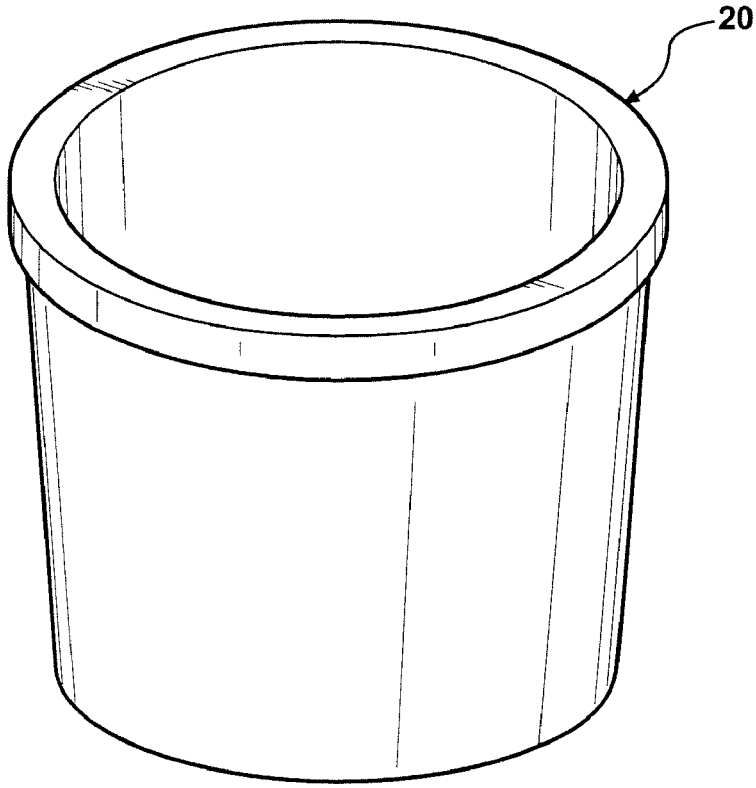
FIG. 5 illustrates a cylinder liner.

The steel material according to the present invention is more preferably suitable for manufacturing piston rings 10 as illustrated in FIG. 4 and/or cylinder liners 20 as illustrated in FIG. 5. Manufactured piston rings and cylinder liners are preferably coated on the flank and/or running surfaces.

The steel material according to the invention reduces the tendency of the workpieces manufactured therefrom of changing their shape under intense heat and thus ensures a continuously high efficiency and additionally reduces the oil consumption. Because of its excellent properties, the steel material according to the invention is thus suitable for the manufacture of piston rings in the automotive and LB-area, or for valve seat rings and guides. In addition to this, it can be used for manufacturing running mechanism seals, (LWD's), back plates for brake pads of disc brakes as well as rings for cooling units, pump nozzles, as well as cylinder liners and protective bushes as well as parts for the chemical industry.

The steel material according to the invention furthermore has the advantage that the manufacture of for example steel piston rings and cylinder liners with the machines and technologies necessary for manufacturing cast iron workpieces becomes possible. In addition, the manufacturing costs correspond to those of cast iron piston rings or cylinder liners, which offers the manufacturer a cost advantage and improved added value. Material parameters can likewise be set free of the supplier.

According to the invention a method for the manufacture of a steel material is additionally provided wherein a melt preferably comprises the chemical compositions mentioned above.

During the melting process in an oven, preferentially a cupola oven, the chemical composition of the melt is adapted as required through the addition of alloys. The tapping temperature of the melt is between 1480 and 1640° C. The properties of the melt can be controlled even before the casting or during the casting through inoculation of the melt. Preferably 650 g of FeSiMg and/or 130 g of Al and/or 650 g of FeSiZr for each 130 kg of melt are employed as nucleus forming agent.

Subsequent to this, a blank is produced subject to the solidification of the melt. Here, the blank can be cast with the methods known from the prior art such as for example centrifugal casting, continuous casting, stamp-press method, croning or greensand forming as single or multiple blank, subsequently heat-treated and further processed into a piston ring or a cylinder liner. Based on the intended purpose of the blank and with the help of his general technical know-how the person skilled in the art will choose the suitable method.

Preferentially heat treatment comprises austenitisation of the steel material at 900 to 1000° C. for one hour, quenching of the steel material in oil or another suitable quenching medium and annealing of the steel material at 420 to 470° C. for an hour.

The following example explains the invention without restricting it.

Example

According to the Invention

Applying the method according to the invention a material is produced having the following composition (% by weight):

| | | | | | |
|---|---|---|---|---|---|
| C: | 1.05 | Mo: | 0.487 | Nb: | 0.0027 |
| Si: | 5.91 | Mn: | 0.464 | Ti: | 0.0074 |
| Ni: | 2.94 | Al: | 0.0082 | V: | 0.0148 |
| P: | 0.0171 | Co: | 0.0141 | Sn: | 0.0082 |
| S: | 0.0285 | Cu: | 0.0433 | W: | 0 |
| | | Cr: | 0.0331 | | |

Remainder: Fe and contaminations due to the manufacture.

The tapping temperature is 1560° C. The casting temperature is 1448° C. The melt is inoculated with 650 g of FeSiMg for each 130 kg of melt. Table 1 shows the mechanical properties of the blank according to the invention in the tempered state.

TABLE 1

Mechanical properties in the tempered state (according to DIN EN 10083-1, 10/96)

| | | | | | |
|---|---|---|---|---|---|
| Diameter [mm] | <16 | >16-40 | >40-100 | >100-160 | >160-250 |
| Thickness [mm] | <8 | 8 < t < 20 | 20 < t < 60 | 60 < t < 100 | 100 < t160 |
| Yield point Re [N/mm$^2$] | min. 900 | min. 750 | min. 650 | min. 550 | min. 500 |
| Tensile Strength RM [N/mm$^2$] | 1100-1400 | 1000-1300 | 900-1200 | 900-1100 | 750-950 |
| Elongation at break A [%] | min. 9 | min. 10 | min. 11 | min. 12 | min. 13 |
| Fracture constriction Z [%] | min. 40 | min. 45 | min. 50 | min. 50 | min. 55 |
| Notch impact work ISO-V [J] | min. 30 | min. 35 | min. 35 | min. 35 | min. 35 |

The invention claimed is:

1. A piston ring comprising a highly siliciferous steel material, said steel material comprising the following composition in % by weight:

| | |
|---|---|
| C: | 0.5 to 1.2 |
| Si: | 3.0 to 15.0 |
| Ni: | 0.5 to 4.5 |
| P: | 0 to 0.035 |
| S: | 0 to 0.035 |
| Cr: | 0 to 3.0 |

with the remainder: Fe and contaminations due to the manufacture, wherein the steel material does not contain any tungsten.

2. The piston ring according to claim 1, wherein at least one of the alloy components, selected from the group, consisting of:

| | | | |
|---|---|---|---|
| Mo: | 0 to 0.5 | Nb: | 0 to 0.01 |
| Mn: | 0 to 1.0 | Ti: | 0 to 0.05 |
| Al: | 0 to 0.05 | V: | 0 to 0.05 |
| Co: | 0 to 0.05 | Sn: | 0 to 0.05 |
| Cu: | 0 to 0.1 | Mg: | 0 to 0.01 |

is contained in the composition in the corresponding quantity listed in % by weight.

3. The piston ring according to claim 2, wherein

C, Si, Ni, P, S, Mo, Mn, Al, Co, Cu, Cr, Nb, Ti, V, Sn and Mg are contained in the steel material in the corresponding quantity listed in % by weight;

C: 0.5 to 1.2; Mo: 0.1 to 0.5; Nb: 0 to 0.005; Si: 5.91 to 10.0; Mn: 0.1 to 0.5; Ti: 0 to 0.01; Ni: 2.94 to 3.5; Al: 0 to 0.01; V: 0 to 0.05; P: 0 to 0.02; Co: 0 to 0.02; Sn: 0 to 0.05; S: 0 to 0.03; Cu: 0 to 0.05; Mg: 0 to 0.01; and Cr: 0 to 3.0.

4. The piston ring according to claim 1, including at least one element in a quantity of up to 0.1% by weight each, selected from the group consisting of tantalum, boron, tellurium and bismuth.

5. The piston ring according to claim 1, including at least one additive material in a quantity of up to 1% by weight each, selected from the group, consisting of aluminium, zirconium, antimony, calcium, strontium, lanthanium, cerium, rare earth metals, NiMg, NiSiMg, FeMg and FeSiMg.

6. The piston ring according to claim 1, wherein the piston ring has a flank and/or a running surface and a coating on the flank and/or running surface.

7. A method for the manufacture of a piston ring comprising a steel material, comprising the following steps:

a. producing a melt having the following composition in % by weight:

| | |
|---|---|
| C: | 0.5 to 1.2 |
| Si: | 5.91 to 15.0 |
| Ni: | 2.94 to 4.5 |
| P: | 0 to 0.035 |
| S: | 0 to 0.035 |
| Cr: | 0 to 3.0 |

with the remainder: Fe and contaminations due to the manufacture, wherein the steel material does not contain any tungsten, b. casting in a prefabricated mold; and c. heat treating the casting.

8. The method according to claim 7, wherein the heat treatment comprises the following steps:

c1. austenitisation of the steel material at 900 to 1000° C. for an hour, c2. quenching of the steel material in a suitable quenching medium, and c3. annealing of the steel material at 420 to 470° C. for an hour.

9. A cylinder liner comprising a highly siliciferous steel material, said steel material comprising the following composition in % by weight:

| | |
|---|---|
| C: | 0.5 to 1.2 |
| Si: | 5.91 to 15.0 |
| Ni: | 2.94 to 4.5 |
| P: | 0 to 0.035 |
| S: | 0 to 0.035 |
| Cr: | 0 to 3.0 |

with the remainder: Fe and contaminations due to the manufacture, wherein the steel material does not contain any tungsten.

10. The cylinder liner according to claim 9, wherein at least one of the alloy components, selected from the group, consisting of:

| | | | | | |
|---|---|---|---|---|---|
| C: | 0.5 to 1.2 | Mo: | 0.1 to 0.5 | Nb: | 0 to 0.005 |
| Si: | 3.0 to 10.0 | Mn: | 0.1 to 0.5 | Ti: | 0 to 0.01 |
| Ni: | 2.0 to 3.5 | Al: | 0 to 0.01 | V: | 0 to 0.05 |
| P: | 0 to 0.02 | Co: | 0 to 0.02 | Sn: | 0 to 0.05 |
| S: | 0 to 0.03 | Cu: | 0 to 0.05 | Mg: | 0 to 0.01 |

is contained in the composition in the corresponding quantity listed in % by weight.

11. The cylinder liner according to claim 10, wherein

C, Si, Ni, P, S, Mo, Mn, Al, Co, Cu, Cr, Nb, Ti, V, Sn and Mg are contained in the steel material in the corresponding quantity listed in % by weight:

C: 0.5 to 1.2; Mo: 0.1 to 0.5; Nb: 0 to 0.005; Si: 5.91 to 10.0; Mn: 0.1 to 0.5; Ti: 0 to 0.01; Ni: 2.94 to Al: 0 to 0.01; V: 0 to 0.05; P: 0 to 0.02; Co: 0 to 0.02; Sn: 0 to 0.05; S: 0 to 0.03; Cu: 0 to 0.05; Mg: 0 to 0.01; and Cr: 0 to 3.0.

12. The cylinder liner according to claim 9, including at least one element in a quantity of up to 0.1% by weight each, selected from the group consisting of tantalum, boron, tellurium and bismuth.

13. The cylinder liner according to claim 9, including at least one additive material in a quantity of up to 1% by weight each, selected from the group, consisting of aluminium, zirconium, antimony, calcium, strontium, lanthanium, cerium, rare earth metals, NiMg, NiSiMg, FeMg and FeSiMg.

14. The cylinder liner according to claim 9, wherein the cylinder has a running surface and a coating on the running surface.

15. A method for the manufacture of a cylinder liner comprising a steel material, comprising the following steps:

a. producing a melt having the following composition in % by weight:

| | |
|---|---|
| C: | 0.5 to 1.2 |
| Si: | 5.91 to 15.0 |
| Ni: | 2.94 to 4.5 |
| P: | 0 to 0.035 |
| S: | 0 to 0.035 |
| Cr: | 0 to 3.0 |

with the remainder: Fe and contaminations due to the manufacture, wherein the steel material does not contain any tungsten, b. casting in a prefabricated mold; and c. heat treating the casting.

16. The method according to claim 15, wherein the heat treatment comprises the following steps:

c1. austenitisation of the steel material at 900 to 1000° C. for an hour, c2. quenching of the steel material in a suitable quenching medium, c3. annealing of the steel material at 420 to 470° C. for an hour.

17. The method according to claim 8, wherein the quenching medium is oil.

18. The method according to claim 16, wherein the quenching medium is oil.

* * * * *